United States Patent [19]

Gauch et al.

[11] 4,057,919

[45] Nov. 15, 1977

[54] LAMINATED DATA CARRIER PROTECTED AGAINST FORGERY, PARTICULARLY IDENTIFICATION CARD

[75] Inventors: Wolfgang Gauch, Lohdorf; Wittich Kaule, Munich; Güenter Pauli, Groebenzell, all of Germany

[73] Assignee: G.A.O. Gesellschaft fur Automation und Organisation mbH, Germany

[21] Appl. No.: 714,261

[22] Filed: Aug. 13, 1976

Related U.S. Application Data

[63] Continuation of Ser. No. 561,634, March 24, 1975, abandoned.

[30] Foreign Application Priority Data

Apr. 2, 1974 Austria ..... 2709/74

[51] Int. Cl.[2] ..... G09F 3/03

[52] U.S. Cl. ..... 40/2.2; 40/135; 283/8 R; 428/43; 428/916

[58] Field of Search ..... 40/2.2, 2 R, 135; 428/916, 915, 199, 198, 203, 204, 201, 43; 283/7, 8 R, 12 R; 427/7; 156/254, 290, 291

[56] References Cited

U.S. PATENT DOCUMENTS

| | | | |
|---|---|---|---|
| 2,780,015 | 2/1957 | Whitehead | 40/2.2 |
| 3,152,901 | 10/1964 | Johnson | 40/2.2 X |
| 3,631,617 | 1/1972 | Pekko | 40/2.2 |
| 3,864,855 | 2/1975 | Pekko et al. | 283/8 R X |

FOREIGN PATENT DOCUMENTS

| | | | |
|---|---|---|---|
| 1,269,514 | 6/1972 | United Kingdom | 283/7 |

*Primary Examiner*—John F. Pitrelli
*Attorney, Agent, or Firm*—McGlew and Tuttle

[57] ABSTRACT

The data carrier is of the type consisting of a data carrying paper blank interposed between two films bonded to the opposite surfaces of the paper blank at respective bonding interfaces. At least one of the bonding interfaces has local areas in which the bond between the film and the respective surface of the paper blank is at least weakened, or omitted, relative to the remainder of the respective bonding interface, so that, when an attempt is made to split the data carrier paper blank along a plane between its opposite surfaces, and the local areas are reached, the tear, following the course of least resistance, will turn toward the surface of the paper blank. This results in a tear at the local areas and thus in the destruction of the respective surfaces of the paper blank. The local areas may be randomly located in the bonding interface or interfaces and, if both bonding interfaces have the local areas, the local non-bonded areas may be randomly located in both bonding interfaces or may be congruently located in both bonding interfaces. The local areas may be formed by either applying a parting compound to the surface or surfaces of the paper blank at the local areas, before bonding of the films thereto, or by appropriate treatment of the films, before bonding to the paper blank, to provide the local areas.

15 Claims, 10 Drawing Figures

LAMINATED DATA CARRIER PROTECTED AGAINST FORGERY, PARTICULARLY IDENTIFICATION CARD

FIELD AND BACKGROUND OF THE INVENTION

This is a continuation, of application Ser. No. 561,634 filed Mar. 24, 1975, now abandoned.

The present invention relates to a laminated data carrier which is protected against forgery, particularly to an identification card.

Data carriers serving to identify persons, for example, are known per se. In everyday life, they are gaining increasing importance as credit cards, employees identity cards, etc. With the constantly increasing use in all areas of life, however, various circles are making increasing efforts to forge such data carriers in order to gain advantages in an unlawful manner. To counteract such fraudulent acts, a great number of identification cards have been proposed in the course of time.

While the safety of known identification cards are very different from each other, the basic structure of most of these cards is the same. They consist of a more or less thick paper blank on which the information necessary for identification as well as safety prints are imposed. For protection against dirt or subsequent entries, the paper blank is inserted between two, preferably transparent, films laminated thereon.

One of the most frequent ways of forging such identification cards is to split the lamination so that the front and the back of the card are obtained as two separate parts. Since the plastic films are permanently joined to the surface of the paper by the lamination, the surface layers of the paper stick to the film during the separating process, so that the films will not be detached from the paper, but the latter will be split midway between the films. The data-carrying surfaces remain undamaged. By combining different fronts and backs or different partial areas thereof, new identification cards are obtained with which the fraudulent acts are committed.

SUMMARY OF THE INVENTION

It is the object of the present invention to propose a laminated data carrier wherein, if attempts are made to split the carrier, important local areas of the printed surface of the paper blank are destroyed in such a manner that use of the data carrier or of parts therefore is no longer possible. The subject matter of the invention is, therefore, a data carrier whose data-carrying areas are locally destroyed if attempts are made to split the carrier midway between its outer surfaces.

According to the invention, either the printed paper blank or the films are locally prepared in such a manner that, during the lamination, the paper and the film are not or only slightly bonded together in these areas so that, when an attempt is made to split the carrier and the prepared areas are reached, the tear, following the smaller resistance, will turn toward the surface of the paper, which results in a tear at these points and thus in the destruction of the information-bearing paper surface there.

In a preferred embodiment of the invention, the front and the back of the paper blank are prepared on the principle according to the invention, so that, if the data carrier is separated, both information bearing surfaces will be destroyed simultaneously.

Especially in the case of thicker paper layers, it is advantageous to prepare the front and the back of the data carrier congruently because the resistance to the central splitting of the paper is very much greater than that to tearing in one of the opposite, prepared areas, so that even in the case of thicker paper the destruction of the surface is insured.

Furthermore, it is especially advantageous to provide the paper blank with a filler which additionally supports the surface-destruction effect.

An example of the invention will be explained with reference to the accompanying drawings of a laminated identification card, the invention being not limited to identification cards. However it will be obvious to those skilled in the art that the principle proposed is applicable to all kinds of laminated data carriers, the structure of the paper blank being just as insignificant as the film material used.

DESCRIPTION OF THE PREFERRED EMBODIMENTS

Figure 1:
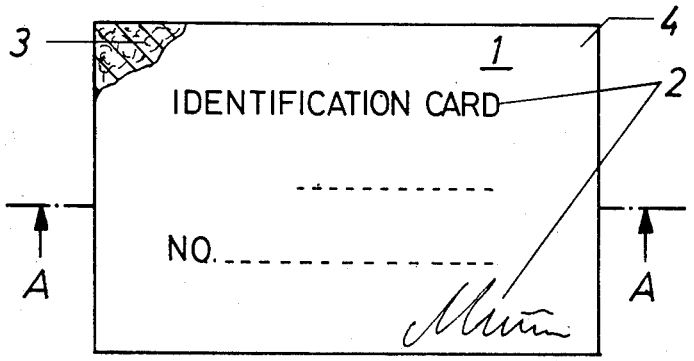
FIG. 1 is a top view of a commonly used identification card.
Figure 2:
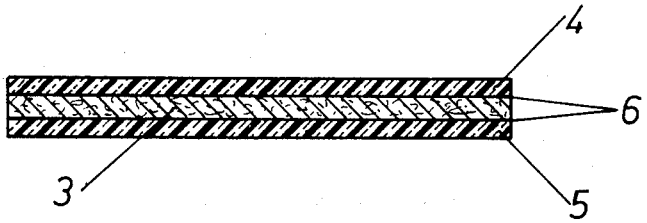
FIG. 2 is a section taken along line A—A of the identification card shown in FIG. 1.

FIG. 1 shows a commonly used identification card 1 which, in this case, represents an employee's identity card, for example. Imposed on the paper blank 3 is all information 2 needed to establish the user's identity, e.g., company name, card number, name, field of work, signature, etc. As can be clearly seen from FIG. 2, this card blank is permanently joined to the film 4 on the front side and to the film 5 on the back at respective bonding interfaces. During the lamination, carried out by means of heat, the adhesive or the thermoplastic film material and the paper are completely fused together in the surface area areas 6. Any subsequent detachment of the film without damaging the card blank is therefore impossible.

Figure 3:
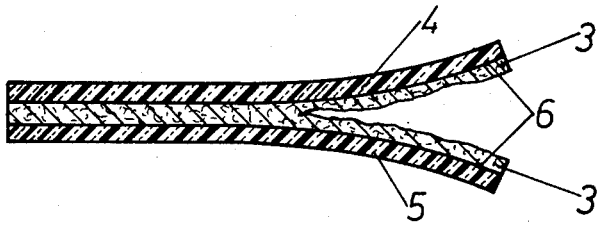
FIG. 3 shows schematically an attempt to split a conventional identification card.
Figure 4:
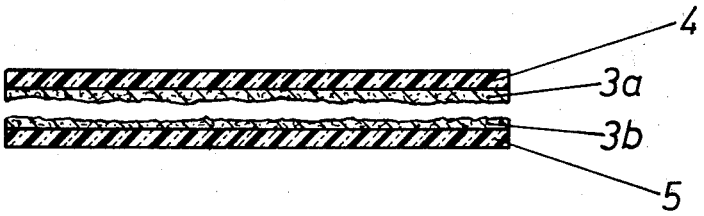
FIG. 4 is a schematic representation of the identification card of FIG. 2 after the card has been split into two parts.

However, if the identification card is split in the middle as shown in FIG. 3, one layer of the card blank will adhere to the upper film 4, and the other to the lower film 5, so that the two halves of FIG. 4 with the parts **3*a* and 3*b*** of the card blank are obtained. Viewed from the side of the film, both halves of this split identification card are completely undamaged. If the front of one identification card is bonded to the back of another, this manipulation will be very difficult to detect during a cursory check.

Figure 5:
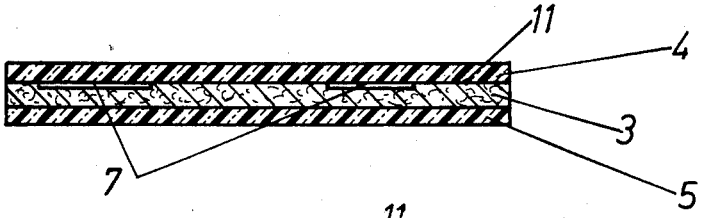
FIG. 5 is a schematic representation of an identification card prepared on one side in accordance with the invention.
Figure 6:
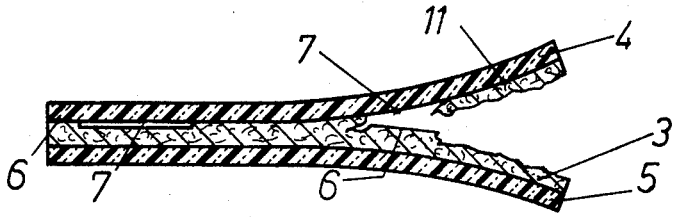
FIG. 6 shows schematically an attempt to split a thus prepared identification card.
Figure 7:
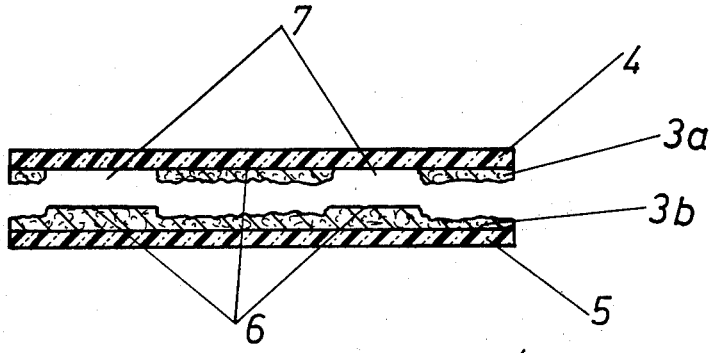
FIG. 7 is a schematic representation of a prepared identification card having been split being into two parts.

The identification card embodying the invention, of which one embodiment is shown schematically in FIG. 5 does not differ in any way from the conventional ones as far as the external appearance is concerned. During the manufacture, however, the card blank is locally prepared in the areas 7 with, e.g. silicone-base, parting compounds in such a manner that, during the lamination, the card blank and the film 4 are not bonded together in these areas. If, as shown in FIG. 6, an attempt is made to split an identification card prepared in this way, the printed surface of the paper will adhere to the bonded-on films in the unprepared areas 11. In the areas 7, however, where the welding of the card blank 3 and the film 4 was prevented, the paper comes off the film completely, i.e., it is not split at these points, but separated from the film without being damaged. This tear from the middle to the surface of the card blank causes a destruction visible from the outside. This destroyed surface makes the use of the two identification-card halves shown in FIG. 7, either in combination with other card halves or by bonding the associated halves together, impossible since the tears on the surface of the paper are clearly visible even if the two parts have been joined very carefully.

Figure 8:
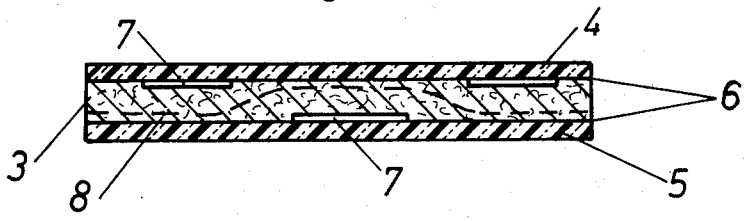
FIG. 8 is a schematic representation of a bilaterally irregularly prepared identification card.
Figure 9:
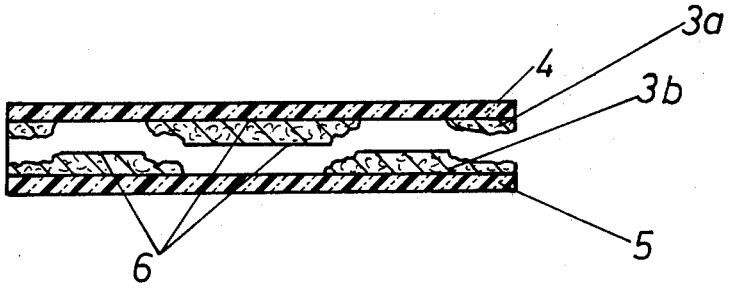
FIG. 9 is a schematic representation of a bilaterally irregularly prepared identification card which has been split.

Especially in the case of thin paper it is not necessary to bring the prepared areas of both sides in a certain relative position. Thus, the preparation of the card blank or of the films may be effected in a more or less arbitrary manner. FIG. 8 shows schematically an identification card with irregularly prepared areas 7, while FIG. 9 shows this identification card in the split condition.

If somewhat thicker safety paper is used, it may happen, however, that, due to accidental, particulary favorable fiber structures of the paper, the split (line 8, FIG. 8) avoids the prepared areas so that the surface to be protected remains undamaged.

Figure 10:
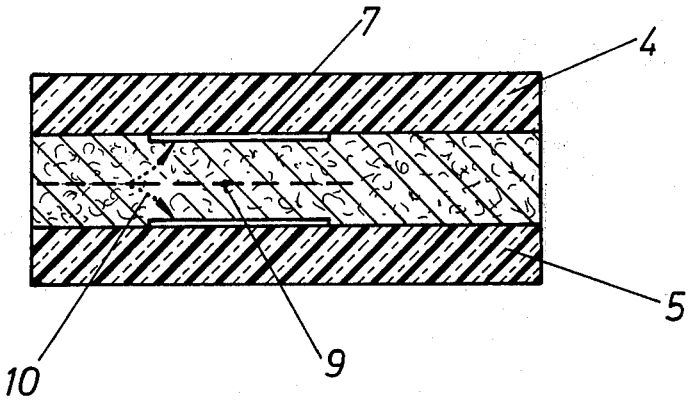
FIG. 10 is a greatly enlarged schematic representation of an identification card prepared congruently on both sides.

Such coincidences can be prevented by effecting the local preparation on the front and on the back congruently. A greatly enlarged view of this variant is shown in FIG. 10. If the tear line shifts toward one of the two sides treated in accordance with the invention, this will automatically lead, in the area 7 to the detachment of the paper from the film and thus to the destruction of the surface.

By additionally increasing the strength of the paper throughout the surface of the card blank, or by selective, partially different reinforcement, the shifting of the tear line can be influenced so that, if the identification card is split up, the surface of the paper will be destroyed with nearly absolute safety independently of the thickness of the paper.

To accomplish this, the paper blank is provided with a filler which binds the fibers of the paper more firmly together and, after the lamination, increases the paper's strength over the whole thickness of the paper.

To this end, in principle, those sides of the film which come into contact with the paper are coated with the filler, leaving free those areas of the card blank which are to be destroyed if the identification card is split up at a later time. Depending on the films used, there are two possibilities of producing this effect. If there were used films which bond very well with the paper during the lamination, as is the case with PVC films, for example, the filler will be applied over the entire surface of the film sides coming into contact with the paper, and thos areas of the card blank which are to be destroyed if the identification card is split up are prepared, as described above, with a parting compound, either on the card blank itself or on the film. If, however, the identification cards are covered with a polyester film or a similar film which bonds with the paper very poorly during the lamination, the preparation with the parting compound can be dispensed with if the filler is applied in only those areas where no destruction of the surface is desired.

During the laminating process, the filler, due to the pressure exerted on the identification card and to the laminating heat, penetrates into the card blank at the points where it comes into direct contact with the paper. This results in the paper being reinforced at these points throughout its entire thickness. In addition, in these areas, the surface of the paper adheres to the films especially well. The different adhesion of the films and the partially different strength of the card blank result in different forces being necessary to split the identification card in the various areas. Taking into account that the tear line always follows the line of least resistance and, consequently, the areas of least paper strength, it is easy to see that, with such preparation of the data carrier, a tear up to the surface of the paper is unavoidable even if relatively thick paper is used.

Suitable fillers are, in principle, all plastic materials which soften under pressure and heat during the laminating process or can be introduced into the paper in the liquid state. To prevent forgers from stripping the film from the card blank by reheating the identification card, it is recommended to use a thermosetting plastic, which, after having been introduced into the paper or after the lamination, does not permit such manipulations.

As mentioned in the description, for preparing local areas, the parting compound need not necessarily be applied to the card blank only. Depending on the manufacturing process, this compound may just as well be applied to the films or to the paper and the films.

What is claimed is:

1. A laminated data carrier protected against forgery, particularly an identification card, consisting of a data-carrying fibrous paper blank interposed between two films bonded to the opposite surfaces of the paper blank at respective bonding interfaces to provide a laminated structure, the adhesion of the fibers of said paper blank to each other being of less strength than that of said bonding interfaces, so that said paper blank is splittable along substantially a plane substantially midway between and substantially parallel to said bonding interfaces, with respective portions of the split paper blank adhering to each of said films at the associated bonding interface; said data carrier having local areas in at least one of said bonding interfaces in which the bond between the film and the respective surface of the paper blank is at least weakened, relative to the remainder of the respective bonding interface, so that, when an attempt is made to split the data carrier paper blank along substantially a plane between its opposite surfaces, and said local areas are reached, the tear, following the source of least resistance, will turn toward the surface of paper blank, resulting in paper blank surface tearing at said local reas and thus visually perceivable paper blank surface destruction.

2. A data carrier according to claim 1, in which the surfaces of said data-carrying paper blank have areas of relatively different strength wherein the areas of greater strength are provided by a paper-fiber-bonding filler material.

3. A data carrier according to claim 2, in which a paper-fiber-bonding-inhibiting parting compound is interposed between the paper fibers in those areas of the paper blank surfaces having relatively lesser strength than the surfaces of the films bonded to the paper blank.

4. A data carrier according to claim 3, in which the parting compound is disposed between a layer of filler on said film and the paper blank surfaces.

5. A data carrier according to claim 3, in which the parting compound is on the surface of the data carrying paper blank.

6. A data carrier according to claim 1, in which only one bonding interface has said local areas.

7. A data carrier according to claim 6, in which said films have respective different thicknesses.

8. A data carrier according to claim 6, in which said films have respective different flexibilities.

9. A data carrier according to claim 1, in which both bonding interfaces have said local areas.

10. A data carrier according to claim 9, in which said local areas, in both bonding interfaces, are randomly located.

11. A data carrier according to claim 9, in which said local areas in one bonding interface are congruent with said local areas in the other bonding interface.

12. A data carrier according to claim 1, in which said local areas in a bonding interface are confined to only certain partial areas of said data carrier.

13. A data carrier according to claim 1, in which said local areas are located at random over the entire surface of said laminated data carrier.

14. A data carrier according to claim 1, in which said local areas are provided in a pattern over the entire surface of said laminated data carrier.

15. A data carrier according to claim 1, in which said local areas in a bonding interface are not visible in the laminated data carrier.

* * * * *